US005893786A

United States Patent [19]

Stevens

[11] Patent Number: 5,893,786

[45] Date of Patent: Apr. 13, 1999

[54] AUTOMATIC TELESCOPING BOUYANT IDENTIFICATION DEVICE FOR USE WITH A WATER SPOUT LIFE VEST

[76] Inventor: Steven R. Stevens, 804 Janelle Ct., Ridgecrest, Calif. 93555

[21] Appl. No.: 09/123,103

[22] Filed: Jul. 27, 1998

[51] Int. Cl.[6] ..... B63C 9/08

[52] U.S. Cl. ..... 441/89; 116/210

[58] Field of Search ..... 441/89; 116/209, 116/210

[56] References Cited

U.S. PATENT DOCUMENTS

| | | | |
|---|---|---|---|
| 3,122,736 | 2/1964 | Weber | 441/89 |
| 4,416,212 | 11/1983 | Howard | 116/210 |
| 4,475,476 | 10/1984 | Howard | 116/210 |
| 4,598,661 | 7/1986 | Roe | 116/209 |
| 4,725,252 | 2/1988 | McNeil | 441/89 |
| 4,752,264 | 6/1988 | Melendez | 441/89 |
| 5,114,369 | 5/1992 | Coffey | 411/11 |
| 5,326,297 | 7/1994 | Loughlin | 441/89 |
| 5,344,351 | 9/1994 | Danielson | 441/89 |
| 5,423,282 | 6/1995 | Krull | 116/209 |
| 5,582,127 | 12/1996 | Willis et al. | 116/210 |
| 5,651,711 | 7/1997 | Samano | 441/89 |

*Primary Examiner*—Jesus D. Sotelo
*Attorney, Agent, or Firm*—John D. Gugliotta

[57] ABSTRACT

An automatic, telescoping, buoyant identification device for use with a water sports life vest is provided having an otherwise conventional life vest/floatation device that is equipped with a telescoping spotting pole or flag mounted to the back of the vest. The spotting pole, constructed of a buoyant foam, slides freely within a tubular main housing such that when the wearer becomes submerged, the spotting pole automatically telescopes from the main housing into the air. It is envisioned that the spotting pole has a visible identification device, such as a flag, mounted on its end. The identification device is colored in a manner such that it will be highly visible to approaching boaters. It is envisioned that the present invention may also be sold as an add-on kit. The unit will attach to existing life vests using fastening devices, such as hook and loop fasteners, ties or belts. It is envisioned that the spotting pole and main housing will be manufactured of a material selected from the group comprising plastic and foam.

12 Claims, 6 Drawing Sheets

AUTOMATIC TELESCOPING BOUYANT IDENTIFICATION DEVICE FOR USE WITH A WATER SPOUT LIFE VEST

RELATED APPLICATIONS

The present invention was first described in a Disclosure Document filed on Feb. 4, 1998. There were no previous applications and no co-pending applications anywhere in the world.

BACKGROUND OF THE INVENTION

1. Field of the Invention

The present invention relates generally to water sports safety equipment and, more particularly, to an automatic, telescoping, buoyant identification device for use with a water sports life vest.

2. Description of the Related Art

Water sports are becoming more popular then ever. Boating, water skiing and riding wave runners are all extremely popular recreational activities. As these activities increase in popularity, so too does the need to follow adequate safety measures. Crowded waters, coupled with the speed at which many water craft travel, create a situation where a collision could cause serious injury or death. These dangers are especially present where water skiers, wave runner riders or other water sports participants fall into the water, making them difficult to spot by other boaters. Accordingly, the need has developed for a means by which one can easily spot those who fall into the water, thus preventing the danger of being struck by other boaters.

In the related art, several patents disclose life vests that include telescoping signaling flags to identify the location of the wearer. These include U.S. Pat. No. 5,651,711, issued in the name of Samano, U.S. Pat. No. 5,114,369, issued in the name of Coffey, U.S. Pat. No. 4,598,661, issued in the name of Roe, U.S. Pat. No. 4,475,476, issued in the name of Howard, and U.S. Pat. No. 4,416,212, issued in the name of Howard.

These devices, however suffer from an inherent design problem. All of these inventions require that the wearer extend the flag manually when he/she enters the water. Thus, protection for the individual is dependent on their remembering to deploy the flag. This causes problems if the person is unconscious, forgets to deploy the flag, or a boat is oncoming quickly.

Two patents disclose life vests that include permanently extended signaling flags to identify the location of the wearer. These are U.S. Pat. No. 5,423,282, issued in the name of Krull et al. and U.S. Pat. No. 4,752,264, issued in the name of Melendez et al.

Other patents disclose signaling devices used to locate people in open waters include U.S. Pat. No. 5,582,127, issued in the name of Willis et al., U.S. Pat. No. 5,344,351, issued in the name of Danielson, U.S. Pat. No. 5,326,297, issued in the name of Loughlin, and U.S. Pat. No. 4,725,252, issued in the name of McNeil.

A search of the prior art did not disclose any patents that read directly on the claims of the instant invention. Consequently, a need has been felt for providing an apparatus and method which overcomes the problems cited above.

SUMMARY OF THE INVENTION

It is therefore an object of the present invention to provide an improved automatic, telescoping, buoyant identification device for use with a water sports life vest that protects water sports enthusiasts in the water by quickly and automatically deploying a bright colored, buoyant identification device, thus alerting oncoming boaters of the presence of the person in the water.

Briefly described according to one embodiment of the present invention, an automatic, telescoping, buoyant identification device for use with a water sports life vest is disclosed, comprising an otherwise conventional life vest/floatation device that is equipped with a telescoping spotting pole or flag mounted to the back of the vest. The spotting pole, constructed of a buoyant foam, slides freely within a tubular main housing such that when the wearer becomes submerged, the spotting pole automatically telescopes from the main housing into the air. It is envisioned that the spotting pole has a visible identification means, such as a flag, mounted on its end. The identification means is colored in a manner such that it will be highly visible to approaching boaters.

It is envisioned that the present invention may also be sold as an add-on kit. The unit will attach to existing life vests using fastening means, such as hook and loop fasteners, ties or belts.

It is envisioned that the spotting pole and housing will be manufactured of a material selected from the group comprising plastic and foam.

It is another object of the present invention to provide a device that ensures that the user is capable of being seen when in the vulnerable, submerged position, without unduly encumbering the person when the person is on the surface of the water.

It is another object of the present invention to provide a buoyant spotting pole and flag that raises and retracts automatically, thereby promoting user safety.

It is another object of the present invention to provide a device that is highly visible in the water.

It is another object of the present invention to provide a device that is universal in design, capable of use with any traditional life vest.

It is another object of the present invention to provide a device that is easy to attach to existing life vests.

It is another object of the present invention to provide a device of plastic and foam construction, thereby making the present invention long lasting, durable and easy to manufacture.

It is another object of the present invention to provide a device made from materials that are all well known to manufacturers and readily available at a reasonable cost.

DESCRIPTIVE KEY

10 automatic, telescoping, buoyant identification device for use with a water sports life vest
20 life vest
30 main housing
40 fastening means
50 main housing flange
60 water inlet
70 spotting pole
80 spotting pole flange
90 identification means

BRIEF DESCRIPTION OF THE DRAWINGS

The advantages and features of the present invention will become better understood with reference to the following more detailed description and claims take in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of automatic, telescoping, buoyant identification device for use with a water sports life vest 10.

The best mode for carrying out the invention is presented in terms of its preferred embodiment, herein depicted within the FIGS. 1 through 6*b*.

1. Detailed Description of the Figures

Figure 1:
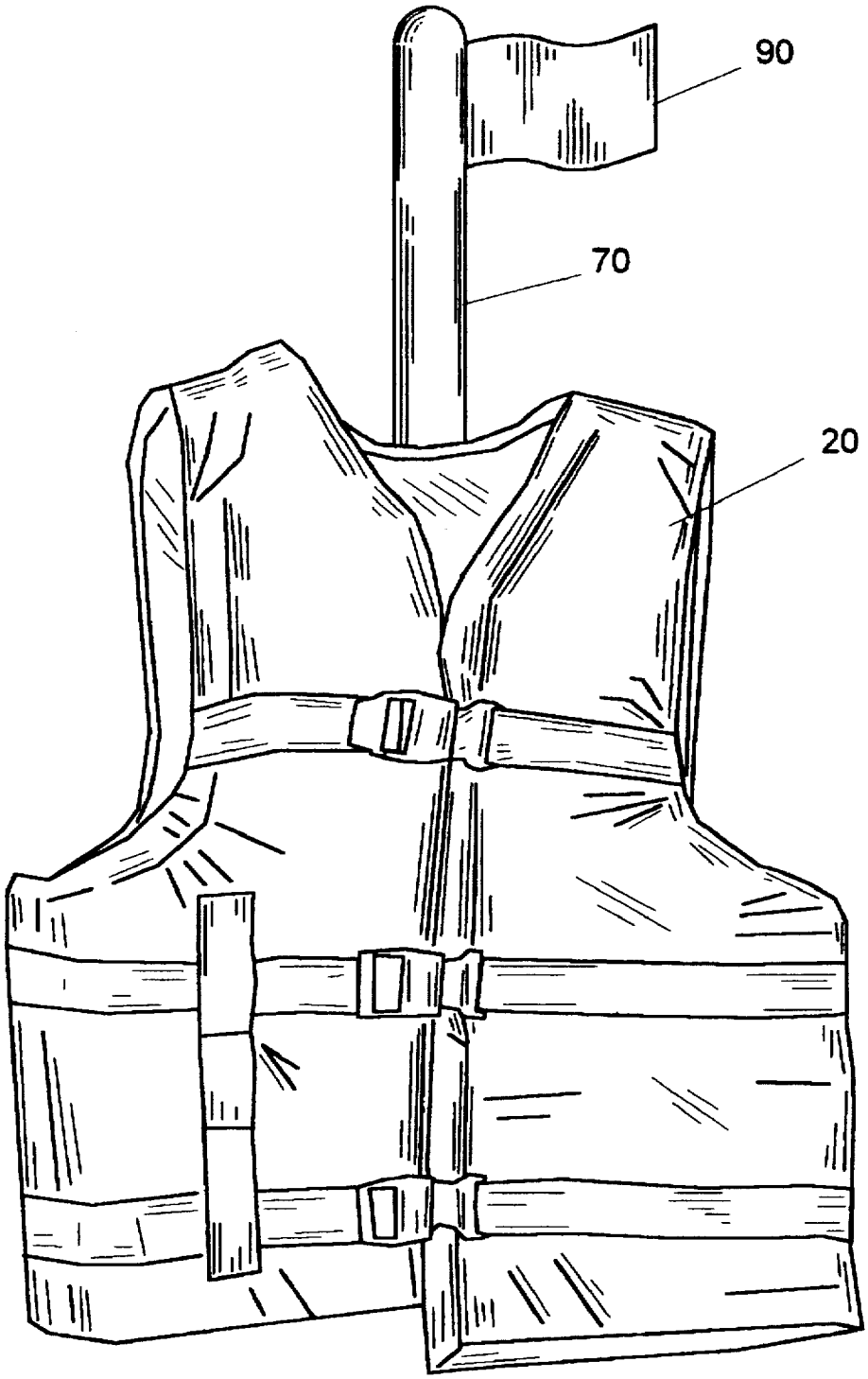
FIG. 1 is a perspective view of the preferred embodiment of an automatic, telescoping, buoyant identification device for use with a water sports life vest 10 in use with a traditional life vest.

Referring now to FIG. 1, an automatic, telescoping, buoyant identification device for use with a water sports life vest 10 is shown, according to the present invention, comprises an otherwise conventional life vest 20/floatation device onto which a main housing 30 is attached.

Figure 2:
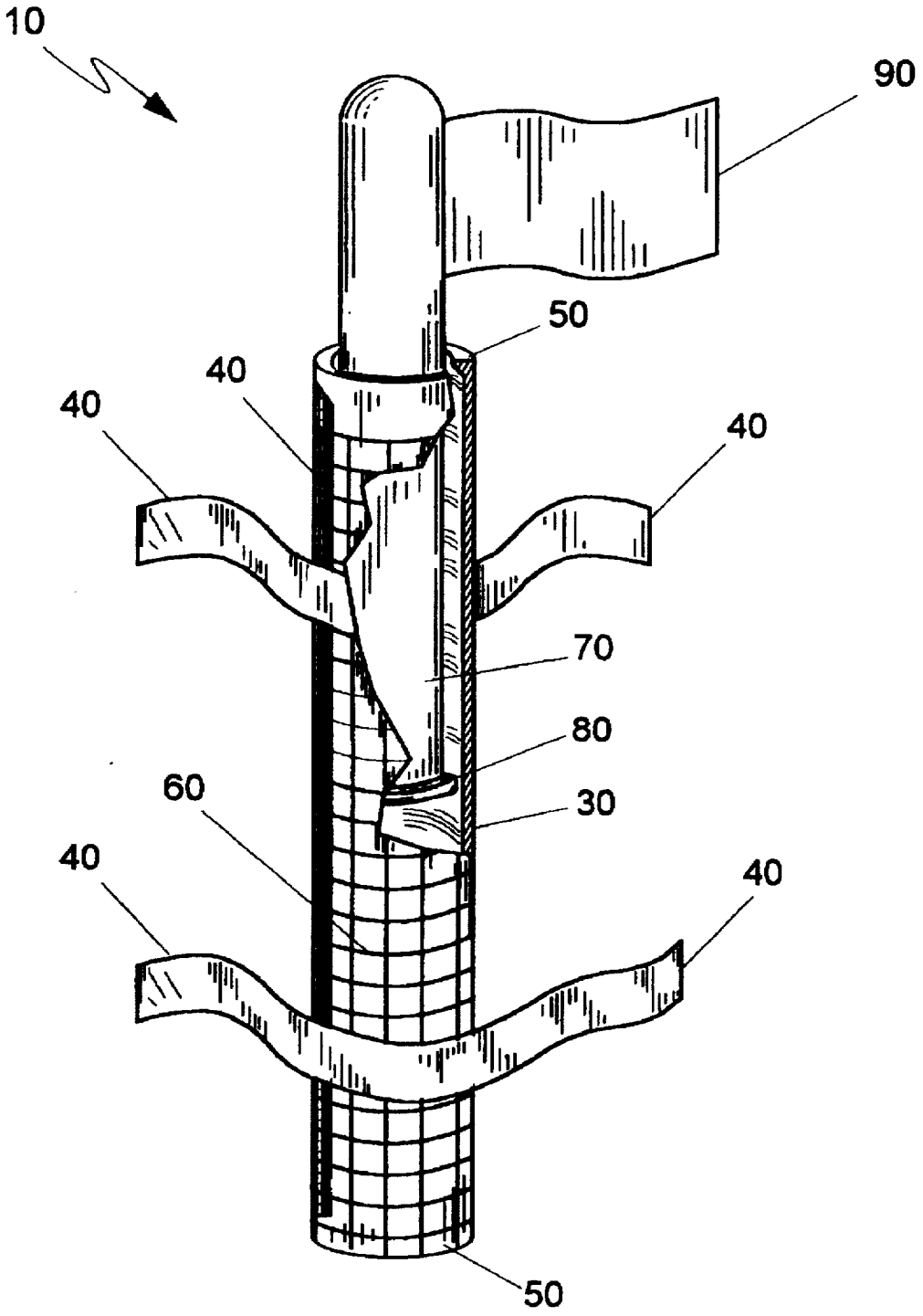
FIG. 2 is a side view of the preferred embodiment thereof.

Referring now to FIG. 2, the main housing 30 is of a generally linearly elongated, cylindrical, hollow configuration. The length of the main housing 30 is proportional to the height of a traditional life vest 20, or approximately 18 inches.

It is envisioned that the main housing 30 is constructed of a strong, lightweight material selected from the group comprising plastic.

Figure 3:
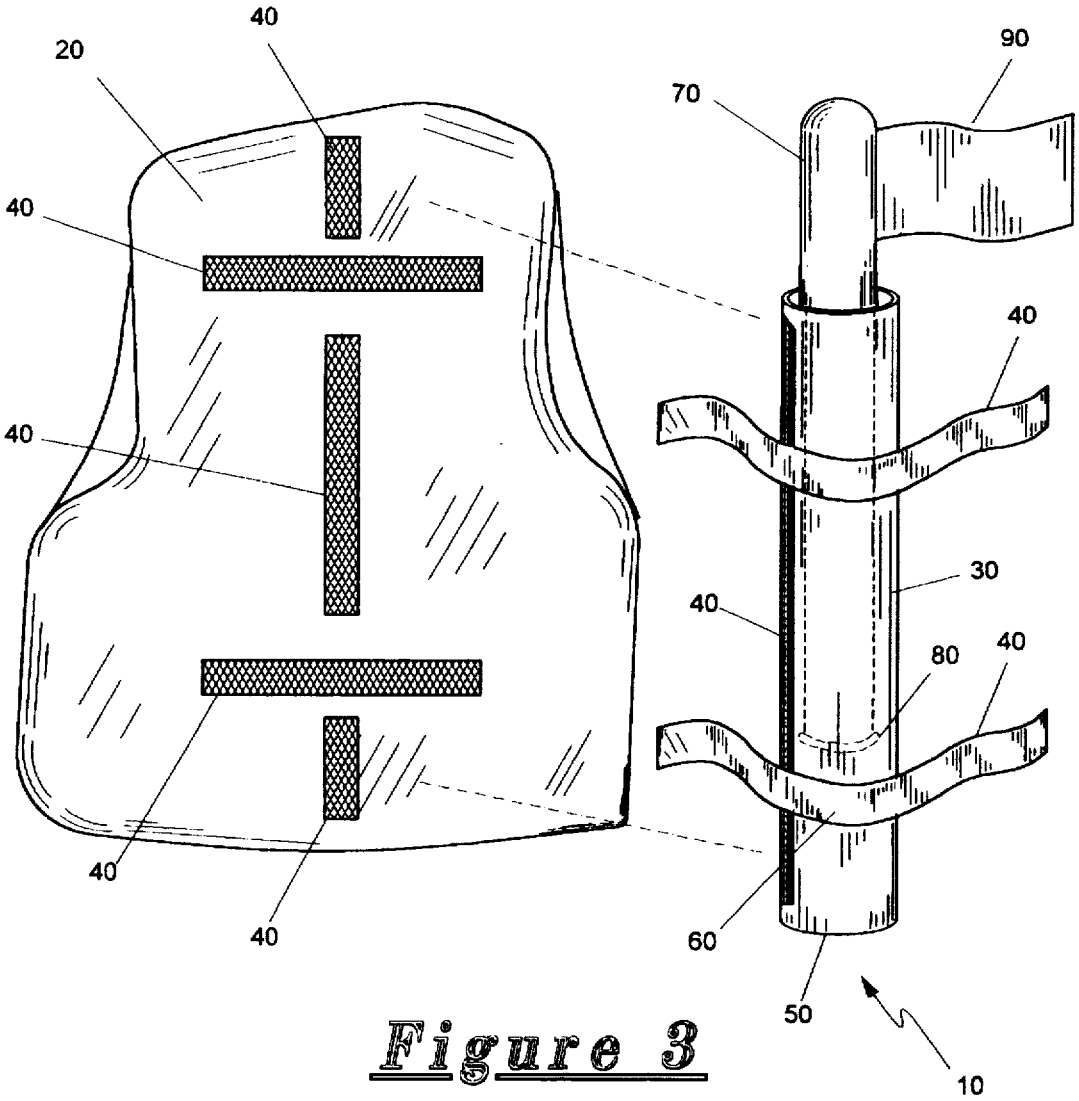
FIG. 3 is an exploded view thereof.

Referring now to FIGS. 2 & 3, the main housing 30 is designed to rest against the exterior surface of the back of a life vest 20, in a vertical line along the lateral center points of the life vest 20.

The main housing 30 is secured to the life vest 20 via a plurality of fastening means 40, such as hook and loop fasteners, attached vertically to the life vest 20 and on the exterior circumferential surface of the main housing 30, along the elongated centerline. A plurality of hook and loop fasteners, ties or belts, may also be used to secure the main housing 30 by passing over the exterior surface of the main housing 30 along the radius of the main housing 30, and connecting to the life vest 20. These fastening means 40 can be integrally designed into the life vest 20 or added on along with the main housing 30.

Figure 4:
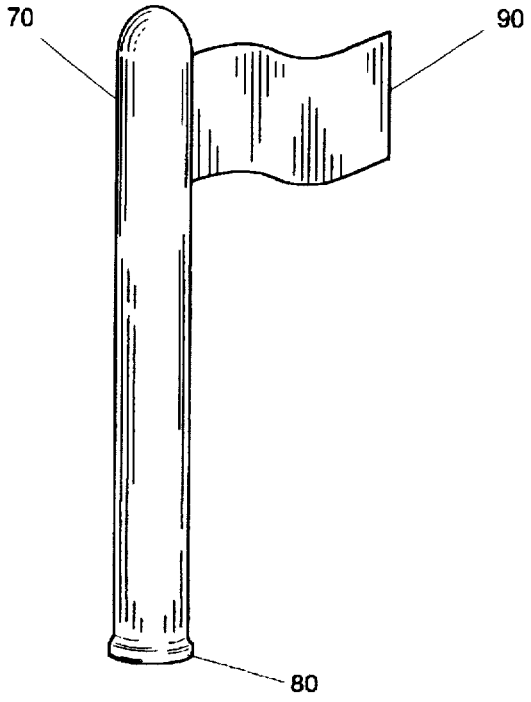
FIG. 4 is a perspective view of the main housing.

Referring now to FIGS. 2 & 4, the main housing 30 is open on both ends, and is vertically positioned on the life vest 20 when the life vest 20 is worn. Extending radially inward from both the top and bottom of the main housing 30, is a set of main housing flanges 50, of generally circular configuration.

Located on the exterior circumferential surface of the main housing 30 is a plurality of water inlets 60. The water inlets 60 may take on a net-like configuration or may consist of plurality of holes. The water inlets 60 are designed to facilitate the quick entrance and exit of water from the main housing 30. The bottom opening of the main housing 30 also serves as a water inlet 60.

Figure 5:
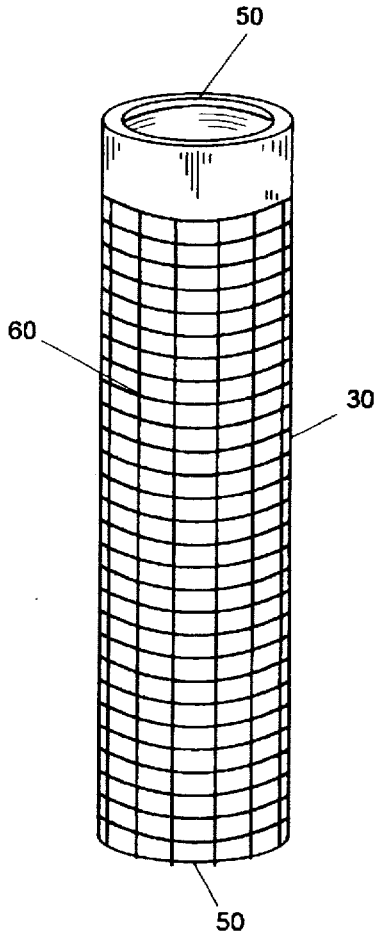
FIG. 5 is a perspective view of the spotting pole.

Referring now to FIGS. 2 & 5, a spotting pole 70, of a linearly elongated, cylindrical configuration, rests inside of and slidably engages the interior surface area of the main housing 30. The spotting pole 70 is constructed of a material selected from the group comprising buoyant foam. The exterior surface of the spotting pole 70 may also be covered in plastic.

Located on the bottom end of the spotting pole 70, located inside the main housing 30, is a spotting pole flange 80, of generally circular configuration, said spotting pole flange 80 extending radially outward from the exterior circumferential surface of the spotting pole 70.

Referring now to FIG. 2, when assembled, the spotting pole flange 80 is positioned in the main housing 30, between the two main housing flanges 50. The spotting pole flange 80 and each main housing flanges 50 are configured and sized such that the spotting pole flange 80 comes into mechanical interference with either of the main housing flanges 50, thereby, limiting continued movement of the spotting pole 70 relative to the main housing 30 in either direction.

Referring now to FIGS. 2 & 5, an identification means 90, such as a colored flag, is connected to the end of the spotting pole 70, opposite the spotting pole flange 80. The identification means 90 is colored in a manner such that it will be highly visible to approaching boaters.

Figure 6A:
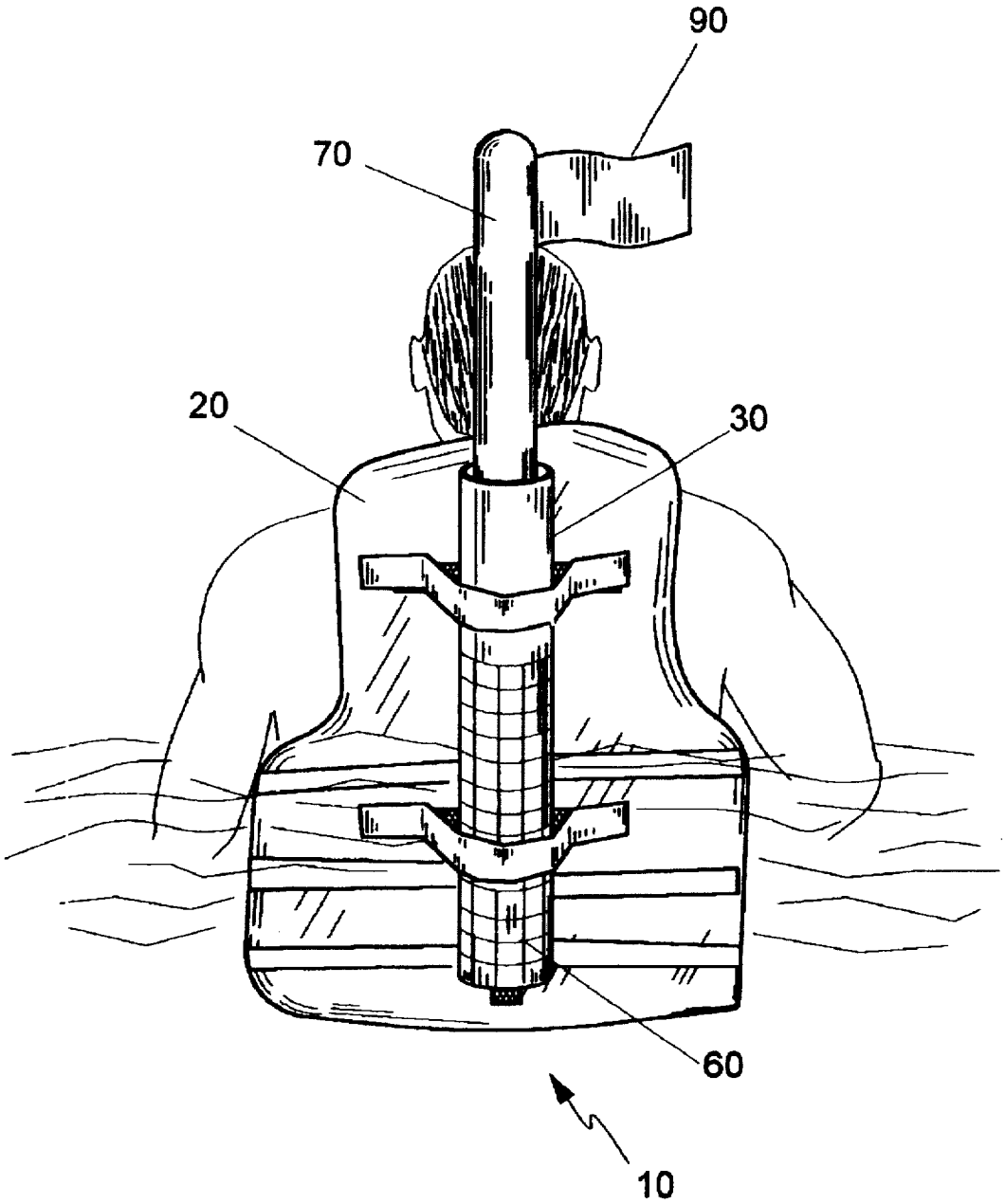
FIG. 6*a* and 6*b* are a set of perspective views of the present invention in various stages of use.

Referring now to FIG. 6*a*, the present invention is configured such that when an individual's life vest 20 becomes submerged in water, water enters the water inlets 60 and the open, bottom end of the main housing 30, filling the main housing 30 with water and extending the spotting pole 70 outward from the main housing 30, along the elongated centerline of the main housing 30.

Figure 6B:
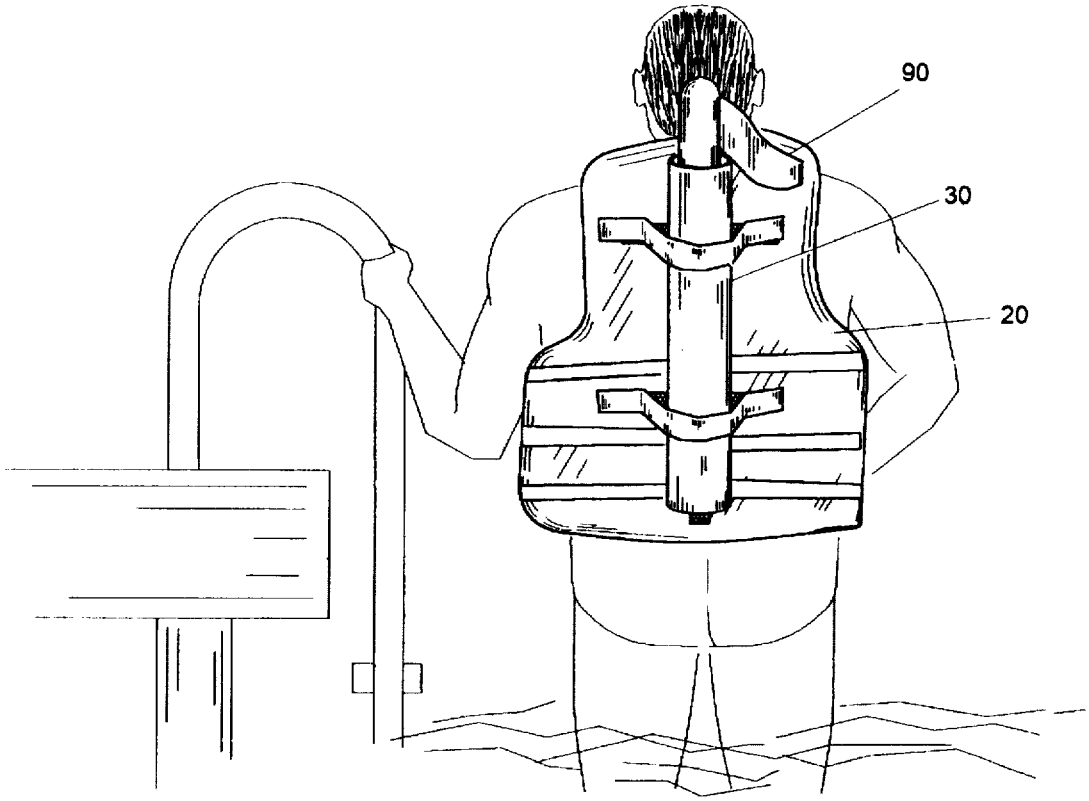

Referring now to FIG. 6*b*, when the main housing 30 is no longer submerged in water, the spotting pole 70 retracts inside the main housing 30.

The spotting pole 70 is of sufficient length such that the identification means 90 can be seen by passing boaters when the spotting pole 70 is in its extended position.

It is envisioned that the present invention may also be sold as an add-on kit. The unit will attach to existing life vests 20 using fastening means 40, such as hook and loop fasteners, ties or belts.

It is envisioned that other styles and configurations of the main housing 30, spotting pole 70 and identification means 90 can be easily incorporated into the teachings of the present invention, and only one particular configuration shall be shown and described for purposes of clarity and disclosure and not by way of limitation of scope.

2. Operation of the Preferred Embodiment

Referring now to FIGS. 3, 6*a* & 6*b*, to use the present invention: first, the operator attaches the present invention to a traditional life vest 20, using the fastening means 40, if the present invention is sold in a kit form, otherwise, the present invention is ready for use; as the life vest 20 that the person is wearing is submerged in water, the water rises up into the main housing 30, forcing the spotting pole 70 and visible identification means 90 into the air. As the life vest 20 is no longer submerged, the water level in the main housing 30 recedes, and the spotting pole 70 retracts inside of the main housing 30. As such, the present invention ensures that the user is capable of being seen when in the vulnerable, submerged position, without unduly encumbering the person when the person is on the surface of the water.

The foregoing description is included to illustrate the operation of the preferred embodiment and is not meant to limit the scope of the invention. The scope of the invention is to be limited only by the following claims.

What is claimed is:

1. An automatic, telescoping, buoyant identification device for use with a water sports life vest, comprising:

a conventional life vest/floatation device;

a main housing, of a generally linearly elongated, cylindrical, hollow configuration, the length of said main housing being proportional to the height of a traditional life vest, or approximately 18 inches, said main housing being open on both ends, and is vertically positioned on said life vest when said life vest is worn;

fastening means, said fastening means used to secure said main housing to said life vest;

main housing flanges, of generally circular configuration, said main housing flanges extending radially inward from both the top and bottom of said main housing;

water inlets, said water inlets located on the exterior circumferential surface of said main housing, said water inlets comprising a plurality of holes, said water inlets designed to facilitate the quick entrance and exit of water from said main housing;

a spotting pole, of a linearly elongated, cylindrical configuration, said spotting pole resting inside of and slidably engaging the interior surface area of said main housing, the exterior surface of said spotting pole;

a spotting pole flange, of a generally circular configuration, said spotting pole flange located on the bottom end of said spotting pole, inside said main housing, said spotting pole flange extending radially outward from the exterior circumferential surface of said spotting pole; and an identification means is connected to the end of said spotting pole, opposite said spotting pole flange; said identification means being colored in a manner such that it will be highly visible to approaching boaters.

2. The automatic, telescoping, buoyant identification device described in claim 1, wherein when assembled, said spotting pole flange is positioned in said main housing, between said two main housing flanges.

3. The automatic, telescoping, buoyant identification device described in claim 1, wherein said spotting pole flange and each main housing flange is configured and sized such that said spotting pole flange comes into mechanical interference with either of said main housing flanges, thereby, limiting continued movement of said spotting pole relative to said main housing in either direction.

4. The automatic, telescoping, buoyant identification device described in claim 1, wherein said fastening means are attached vertically to said life vest and on the exterior circumferential surface of said main housing, along the elongated centerline of said main housing.

5. The automatic, telescoping, buoyant identification device described in claim 1, wherein fastening means are used to secure said main housing by passing over the exterior surface of said main housing along the radius of said main housing, and connecting to said life vest; said fastening means being either integrally designed into said life vest or added on along with said main housing.

6. The automatic, telescoping, buoyant identification device described in claim 1, wherein said main housing is constructed of a strong, lightweight material comprising plastic.

7. The automatic, telescoping, buoyant identification device described in claim 1, wherein said spotting pole is constructed of a material comprising buoyant foam.

8. The automatic, telescoping, buoyant identification device described in claim 1, wherein the present invention is configured such that when an individual's life vest becomes submerged in water, water enters said water inlets and the open, bottom end of said main housing, filling said main housing with water and extending said spotting pole outward from said main housing, along the elongated centerline of said main housing.

9. The automatic, telescoping, buoyant identification device described in claim 1, wherein when said main housing is no longer submerged in water, said spotting pole retracts inside said main housing.

10. The automatic, telescoping, buoyant identification device described in claim 1, wherein said spotting pole is of sufficient length such that said identification means can be seen by passing boaters when said spotting pole is in its extended position.

11. The automatic, telescoping, buoyant identification device described in claim 1, wherein said main housing is designed to rest against the exterior surface of the back of said life vest, in a vertical line along the lateral center points of said life vest.

12. The automatic, telescoping, buoyant identification device described in claim 1, wherein the bottom opening of said main housing also serving as a water inlet.

* * * * *